United States Patent [19]

Grossman

[11] Patent Number: 4,646,493

[45] Date of Patent: Mar. 3, 1987

[54] COMPOSITE PRE-STRESSED STRUCTURAL MEMBER AND METHOD OF FORMING SAME

[75] Inventor: Stanley J. Grossman, Norman, Okla.

[73] Assignee: Keith & Grossman Leasing Co., Norman, Okla.

[21] Appl. No.: 719,339

[22] Filed: Apr. 3, 1985

[51] Int. Cl.[4] ..... E04C 3/26; E04C 3/294; B28B 9/04

[52] U.S. Cl. ..... 52/223 R; 52/334; 52/729; 264/228

[58] Field of Search ..... 52/223 R, 334, 729; 264/228

[56] References Cited

U.S. PATENT DOCUMENTS

| | | | |
|---|---|---|---|
| 152,794 | 7/1874 | Coolidge et al. | 52/729 |
| 1,652,056 | 12/1927 | Selway | 52/729 |
| 2,373,072 | 4/1945 | Wichert | 52/223 R |
| 2,382,138 | 8/1945 | Cueni | 72/71 |
| 2,382,139 | 8/1945 | Cueni | 72/71 |
| 2,725,612 | 12/1955 | Lipski | 25/154 |
| 3,166,830 | 1/1965 | Greulich | 52/225 X |
| 3,305,612 | 2/1967 | Frantz | 264/69 |
| 3,588,971 | 6/1971 | Lipski | 25/118 T |
| 3,608,048 | 9/1971 | Lipski | 264/228 |
| 4,093,689 | 6/1978 | Mayer et al. | 264/71 |
| 4,279,680 | 7/1981 | Watson, Jr. | 156/212 |
| 4,493,177 | 1/1985 | Grossman | 52/22 RR |

FOREIGN PATENT DOCUMENTS

| | | | |
|---|---|---|---|
| 2593 | of 1865 | United Kingdom | 52/729 |
| 259 | of 1884 | United Kingdom | 52/729 |

*Primary Examiner*—Alfred C. Perham

*Attorney, Agent, or Firm*—Laney, Dougherty, Hessin & Beavers

[57] ABSTRACT

An improved composite, pre-stressed structural member and method of forming such a member of the type provided by upside down forming which includes connecting the steel beams of the composite member to the upper side of a mold so that a parallel deflection of the mold and beams occurs as the mold is filled with concrete. The improvement comprises utilizing a steel beam having a flange at or near the neutral axis with respect to a vertical deflection of the support member. After the composite structure is formed, the flange is away from the neutral axis with respect to a vertical deflection of the composite structure. This flange, therefore, significantly increases the section modulus of the composite structure while not adding significantly to the resistance to bending of the beam during pre-stressing. Stacked and welded I-beams are an example of a support in accordance wth this invention.

9 Claims, 5 Drawing Figures

COMPOSITE PRE-STRESSED STRUCTURAL MEMBER AND METHOD OF FORMING SAME

BACKGROUND OF THE INVENTION

1. Field of the Invention

This invention relates in general to structural members and methods of forming structural members. More particularly, but not by way of limitation, it relates to composite, pre-stressed structural members and methods and apparatus for forming, designing and pre-stressing such structural members.

2. Description of the Prior Art

In the field of constructing composite, pre-stressed structural members, many methods of pre-stressing are available. A particularly desirable method of pre-stressing such composite structural members is shown in my U.S. Pat. No. 4,493,177 and my U.S. Patent Application Ser. No. 688,272, filed Jan. 2, 1985. The pre-stressing disclosed in this patent and patent application is achieved by forming the composite structure upside down. The upside down forming includes connecting the steel beams of the composite member to the upper side of a mold so that shear connectors extend downwardly into the mold. The steel beams and the mold are joined and supported so that deflection of the mold causes a parallel deflection of the steel beams. As the mold is filled with concrete, the steel beams and mold deflect downwardly from the weight of the beams, mold and concrete, thus pre-stressing the beams. The top flange of the inverted beams (bottom flange when upright) receives a compression pre-stress. After the concrete hardens, the mold is removed and the connected beams and concrete slab are inverted so that the composite structure is upright. In the upright position the bottom flange of the beams receives a tension stress which is reduced by the compression pre-stress achieved by the inverted molding. The concrete, of course, receives a compression stress.

This type of pre-stressing is especially desirable because it produces an improved pre-stress resulting from the pouring of the concrete itself. No separate pre-stress activity is required. In addition, because the uppermost or surface concrete is the concrete formed at the bottom of the mold, the concrete surface is less permeable and harder than concrete structures which are not inverted. Still further, this type of pre-stressing results in a pre-stress relationship based upon the weight distribution of the concrete and beam combination. This pre-stress relationship is much improved compared to pre-stressing resulting from jacks which concentrates more of the pre-stressing at a single point.

Despite the great improvements over the structures and methods of the prior art, my method and apparatus can be further improved by the invention described herein. Particularly, the present invention provides improved strength and resistance to bending with less cost.

SUMMARY OF THE INVENTION

The present invention provides an improved composite, prestressed structural member and method of forming the same. The structure includes a concrete slab supported by a metal support member and connected to the support member by shear connectors. The method of forming the composite structure and pre-stressing the support member comprises an inverted parallel deflection of the slab mold and support member as described in my U.S. Pat. NO. 4,493,177. The improvement in the method and structure result from the support member having a flange at or near the neutral axis with respect to a vertical deflection of the inverted support member. Thus, as the support member is deflected in the inverted position, this flange, at or near the neutral axis, does not add significantly to the resistance to bending. However, after the concrete is hardened and the composite, pre-stressed structural member is placed upright, the neutral axis of the composite structure is near the top of the support member and away from this flange. The flange, therefore, increases the section modulus of the upright composite structure while not producing a significant resistance to bending in the formation process.

A particularly desirable lower support member includes first and second beams which have first and second flanges, respectively, which together form the flange near the neutral axis of the inverted support member. For example, two I-beams can be stacked and their flanges welded together to form the support member. Often the cost per pound of the smaller beams is less than the cost per pound of the larger beams reducing the cost even further than simply the savings produced by reducing the amount of steel.

For a further understanding of the invention, and further objects, features and advantages thereof, reference may now be had to the following description taken in conjunction with the accompanying drawings.

DESCRIPTION OF THE PREFERRED EMBODIMENTS

The method and apparatus of the present invention are especially suited for use in connection with the method and apparatus described in my U.S. Pat. No. 4,493,177 and my U.S. Pat. Application Ser. No. 688,272 filed Jan. 2, 1985. For a further understanding of this invention, reference should be made to the descriptions in this patent and patent application, which description is hereby incorporated by reference herein.

Figure 1:
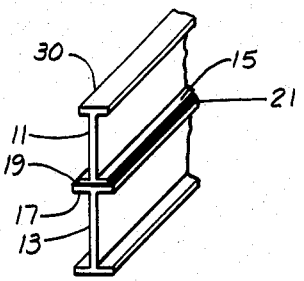
FIG. 1 is a perspective view of a portion of two stacked and joined beams in accordance with the present invention.

Referring now to FIG. 1, the present invention provides a support for a composite, pre-stressed structural member which comprises stacked steel I-beams 11 and 13. The upper beam 11 is welded at its lower flange 15 to the upper flange 17 of the lower beam 13. If, as shown in FIG. 1, the I-beams 11 and 13 are of sufficiently different size, a welding surface 19 is provided on the larger flange. A continuous weld 21 (or spot-welds at regular intervals) along the welding surface 19 is necessary in order to completely secure the I-beams 11 and 13 with respect to each other.

Figure 2:
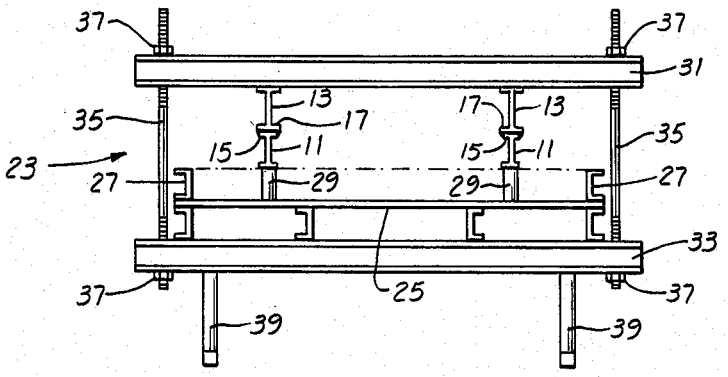
FIG. 2 is a cross-sectional view of a composite, pre-stressed structural member being formed in accordance with the method and apparatus of the present invention.

Referring now to FIG. 2, once the stacked beams 11 and 13 have been joined, they are inverted and placed in a molding apparatus 23. The molding apparatus includes a mold bottom 25 and mold sides 27 which form the mold into which the concrete is to be poured. Spacers 29 support the beams 11 and 13 at the ends of the mold so that the beams have a proper height with respect to the bottom surface 25 of the mold. The spacers are also part of the end support system. Shear connectors 47 extend downwardly into the mold from flange 30 of beam 11.

A connection assembly including upper cross beams 31 and lower cross beams 33 joined by connection rods 35 connect the beams 11 and 13 to the mold. The connection assemblies are spaced along the beams 11 and 13 and the mold so that deflection of the mold causes a parallel deflection of the beams 11 and 13. Nuts 37 are threaded to opposite ends of the rods 35 to adjustably join the upper cross beam 31 to the lower cross beam 33. The entire connected mold and cross beams are supported at opposite ends by end supports 39.

Figure 3:
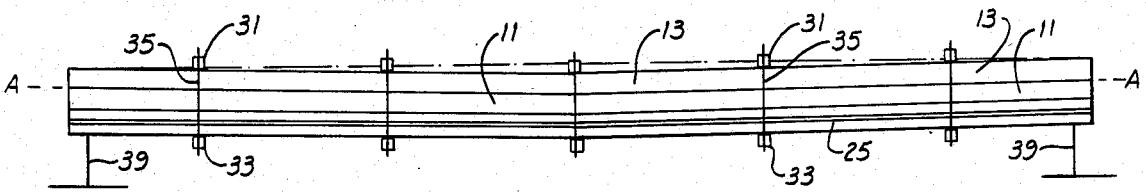
FIG. 3 is a schematic side elevational view of the structural member of the present invention during one of the formation steps.

Referring now to FIG. 3, following the preparation of the connected mold and beams, concrete is poured into the mold causing the beams 11 and 13 and the mold to deflect downwardly between the supports 39. As the beams 11 and 13 deflect downwardly due to the weight of the beam, the mold and the wet concrete, the neutral axis A—A of the inverted deflected beams is at or near the joined middle flanges 15 and 17.

Figure 4:
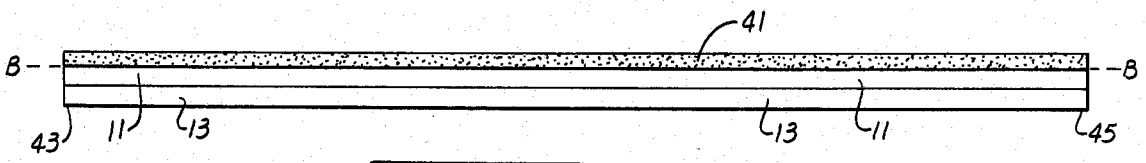
FIG. 4 is a schematic side elevational view of a structural member of the present invention ready for use.

After the concrete has been poured into the mold causing deflection of the beams and mold, the concrete is allowed to harden into a concrete slab 41. The concrete slab 41 is fixed to the beams 11 and 13 by the shear connectors 47 which extend from the flange 30 of beam 11 into the concrete slab 41. Following hardening of the concrete slab 41, the mold is removed from the concrete and the composite slab and beams are turned upright as shown in FIG. 4. When in use, this composite structural member will be supported at its ends 43 and 45. Considering the composite structure supported at its ends, the bending moment of live and dead loads on the composite member causes a downward deflection of the composite member. The neutral axis B—B of the composite structure with respect to a vertical deflection is at or near the upper flange 30 of beam 11. With the neutral axis B—B near the flange 30, the flanges 15 and 17 are sufficiently below the neutral axis to greatly increase the section modulus of the composite structure compared to a composite structure supported by appropriately designed single I-beams. This provides a much improved resistance to bending of the composite, prestressed structural member.

The advantage of the stacked beams 11 and 13 in the method and apparatus described herein is that a high section modulus in the combined structural member is obtained while retaining a low section modulus in the beams 11 and 13 as the concrete is poured to form slab 41. This allows less steel to be used while obtaining the same or a higher section modulus. Further, because the cost of the combined, smaller beams is often less than the cost of a single beam of the same weight, the cost reduction is even more than the savings in steel.

Figure 5:
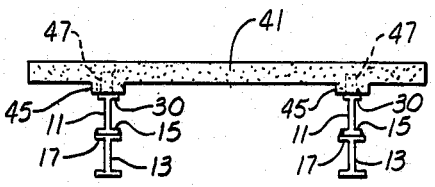
FIG. 5 is an end view of a structural member constructed in accordance with the present invention.

Referring now to FIG. 5, an end view of the composite structure is shown including haunches 45 in the concrete slab 41 providing a neutral axis of the composite member farther from the flanges 15 and 17 of the beams 11 and 13. The haunches 45 can be formed by pouring the concrete in two steps. First, the concrete is poured into a desired slab level in the mold and allowed to sufficiently harden so as to support a second pour. New forms are placed on either side of the shear connectors 47 to form the mold space for the haunches 45. The haunches 45 are then poured up to the height of the flange 30 of beam 11. The shear connectors 47 extend into the first pour through the haunches 45.

While the above embodiments show stacked and welded I-beams, many beams or combinations of beams having a flange near the neutral axis of the beam or beams can achieve the desired result of a low section modulus as the beams are pre-stressed and a high section modulus in the composite structure. For example, T-shaped beams could be welded to a middle plate (the neutral axis flange) to achieve a custom-designed ratio of beam section modulus to composite structure section modulus.

EXAMPLES

The following calculations detail the design of two composite structures having a 60 foot span with a slab 10.67 feet wide and 7 inches thick. Example 1 is supported by two single cover plated I-beams (W24×55) and Example 2 is supported by two stacked I-beams (W14×22, top and W18×35, bottom). The two structures are pre-stressed and formed as described above, except Example 1 uses single beams without flanges at the neutral axis.

List of Symbols:

- I = Moment of inertia (in.$^3$)
- $f_b$, $f_t$ = Calculated stress in bottom or top flange underload (PSI)
- (C) = Compressive Stress (PSI)
- (T) = Tensile Stress (PSI)
- LL = Live Load
- N = Ratio of modulus of elasticity of steel to modulus of elasticity of concrete (7 for short term live loads and 21 for long term dead loads.
- $f_c$ = Calculated stress of concrete (PSI)
- M = Moment (Ft-Lb)

Example 1:

| | | |
|---|---|---|
| 1. | Neutral Axis of Steel = | 10.40 IN |
| 2. | Weight of one Girder = | 65.20 LBS/FT |
| 3. | Moment of Inertia of one Girder = | 1716.32 IN-4 |
| 4. | Sect. Mod. - Top of one Girder = | 125.57 IN-3 |
| 5. | Sect. Mod. - Bottom of one Girder = | 165.00 IN-3 |
| 6. | The Concrete Strength = | 5000. PSI |
| 7. | Top Reinf. Steel in slab = 15 Number | 4 Bars |
| 8. | Bottom Reinf. Steel in slab = 8 Number | 4 Bars |
| 9. | The Value of N is: | 7. |
| 10. | Neutral Axis Location: | 23.70 IN |
| 11. | I - Composite Section: | 12710.01 IN-4 |
| 12. | Section Modulus - Conc: | 1723.94 IN-3 |
| 13. | Sect. Mod. - Top Flange: | 34107.49 IN-3 |
| 14. | Section Modulus - Bottom: | 536.35 IN-3 |
| 15. | The Value of N is: | 21. |
| 16. | Neutral Axis Location: | 19.93 IN |
| 17. | I - Composite Section: | 9859.51 IN-4 |
| 18. | Section Modulus - Conc: | 885.16 IN-3 |
| 19. | Sect. Mod. - Top Flange: | 2382.29 IN-3 |
| 20. | Section Modulus - Bottom: | 494.67 IN-3 |

21. Prestress $f_b = \frac{541.89(12)}{2(165)} = 19.71(C)$ $f_t = \frac{541.89(12)}{2(125.57)} = 25.89(T)$ 22. Turnover $f_b = \frac{996.75(12)}{494.67} = 24.18(T)$ Overlay $f_b = \frac{92.83(12)}{494.67} = 2.25(T)$ -continued (LL + I) $f_b = \frac{972.26(12)}{536.35} = \underline{21.75(T)}$ $\Sigma f_b =$ 28.47(T) > 27 KSI 23. $1.47 = \frac{12(M)}{2(165)} - \frac{12(M)}{494.67}$ M = 121.44 (Extra required pre-stress moment)

24. $\Sigma f_t = 25.89 + \frac{121.44(12)}{2(125.57)} - \frac{(1089.58 + 121.44)(12)}{2382.29} - \frac{972.26(12)}{34,107.5}$ $= 25.89 + 5.80 - 6.10 - 0.34$ $\Sigma f_t = 25.25(T) < 27$ KSI 25. Turnover + Overlay + Pre-stress $f_c = \frac{1211.02(12)}{885.16(21)} = 0.781(C)$ (LL + I) $f_b = \frac{972.26(12)}{1723.94(7)} = \underline{0.967(C)}$ $\Sigma f_c =$ 1.748(C) < 2.0 KSI Example 2:

| | | |
|---|---|---|
| 1. | Neutral Axis of Steel = | 14.92 IN |
| 2. | Weight of one Girder = | 57.00 LBS/FT |
| 3. | Moment of Inertia of one Girder = | 1689.98 IN-4 |
| 4. | Sect. Mod. - Top of one Girder = | 102.28 IN-3 |
| 5. | Sect. Mod. - Bottom of one Girder = | 113.29 IN-3 |
| 6. | The Concrete Strength = | 5000. PSI |
| 7. | Top Steel = 15 Number 4 Bars | |
| 8. | Bottom Steel = 8 Number 4 Bars | |
| 9. | The Value of N is: | 7. |
| 10. | Neutral Axis Location: | 30.88 IN |
| 11. | I - Composite Section: | 14615.64 IN-4 |
| 12. | Section Modulus - Conc: | 1933.54 IN-3 |
| 13. | Sect. Mod. - Top Flange: | 26146.51 IN-3 |
| 14. | Section Modulus - Bottom: | 473.29 IN-3 |
| 15. | The Value of N is: | 21. |
| 16. | Neutral Axis Location: | 26.66 IN |
| 17. | I - Composite Section: | 11422.92 IN-4 |
| 18. | Section Modulus - Conc: | 969.97 IN-3 |
| 19. | Sect. Mod. - Top Flange: | 2391.44 IN-3 |
| 20. | Section Modulus - Bottom: | 428.41 IN-3 |

21. Prestress $f_b = \frac{(48.73 + 87.03 + 406.13)(12)}{2(113.29)} = 28.70$ (C)

$f_t = \frac{541.89(12)}{2(102.28)} = 31.79(T)$

22. Turnover $f_b = \frac{996.75(12)}{428.41} = 27.92(T)$

Overlay $f_b = \frac{92.88(12)}{494.41} = 2.60(T)$ (LL + I) $f_b = \frac{972.26(12)}{473.29} = \underline{24.65(T)}$ $\Sigma f_b =$ 26.47(T) < 27 KSI 23. Turnover + Overlay $f_t = \frac{1,089.58(12)}{2391.44} = 5.47(C)$ (LL + I) $f_t = \frac{972.26(12)}{26,146.5} = \underline{0.45(C)}$ $\Sigma f_t =$ 25.87(T) < 27 KSI 24. Turnover + Overlay $f_c = \frac{1089.58(12)}{969.97(21)} = 0.642(C)$ (LL + I) $f_b = \frac{972.26(12)}{1933.54(7)} = \underline{0.862(C)}$ -continued $\Sigma f_c =$ 1.504(C) < 2.0 KSI Both of the above designs are acceptable resulting in very similar final stresses. However, the stacked beam example is clearly superior because it uses less steel, requires no added pre-stress momen, has a lower concrete stress, and will deflect less. One way of determining the superiority of the stacked beam example versus the cover plated rolled beam (I-beam) example is to compare the ratio of composite to non-composite section modulii.

The example 1 section modulus ratio is $$536.35/(2\times165)=1.63$$

while the example 2 section modulus ratio is $$473.29/(2\times113.29)=2.09$$

Thus, the composite, pre-stressed structural member of the present invention and the method and apparatus for forming the structural member are well adapted to attain the objects and advantages mentioned as well as those inherent therein. While presently preferred embodiments of the invention have been described for the purpose of this disclosure, numerous changes in the construction and arrangement of parts and in the steps of the method can be made by those skilled in the art, which changes are encompassed within the spirit of this invention is defined by the appended claims.

The foregoing disclosure and the showings made in the drawings are merely illustrative of the principles of this invention and are not to be interpreted in a limiting sense.

What is claimed is:

1. An improved composite, pre-stressed structural member of the type including a molded upper concrete slab supported by a lower metal support member extending beneath and connected by shear connection means to said molded upper concrete slab, said metal support member having been joined with said slab and pre-stressed by connecting the support member to the upper side of a mold so that deflection of the mold causes an approximately parallel deflection of the support member, with the mold and support member being supported so that deflection of the mold and support member can occur, and the concrete slab having been formed by filling the mold with concrete which deflects the mold and support member so that the support member is pre-stressed by the deflection; the improvement comprising:

the support member having a flange at or near the neutral axis with respect to a vertical deflection of the support member when in an inverted position and spaced away from the neutral axis with respect to a vertical deflection of the composite structure when in an upright position, for increasing the resistance to bending of the composite structure when in said upright position.

2. The composite structure of claim 1 wherein said support member comprises:

first and second beams stacked and joined at said flange.

3. The composite structure of claim 2 wherein said first and second beams have first and second flanges, respectively, which together, form said flange.

4. The composite structure of claim 3 wherein said first and second flanges are welded together to form said flange.

5. A method of forming a composite, pre-stressed structural member of the type having an upper molded surface supported by a lower support member comprising:

connecting a lower support member having a flange at or near the neutral axis with respect to a vertical deflection of the support member to the upper side of a mold so that deflection of the mold causes deflection of the support member and such that support member connector means extend downwardly into said mold;

supporting the mold and lower support member so that deflection of the mold and lower support member can occur;

filling the mold with a moldable material which hardens to form a composite structural member with said lower support member;

deflecting the mold during hardening of the moldable material such that the support member is placed in a pre-stressed condition to form a composite, pre-stressed structural member upon hardening of the moldable material; and after hardening of the moldable material, inverting the composite, pre-stressed structural member such that the lower support member is beneath and supports the hardened moldable material and such that the composite, pre-stressed structural member has a neutral axis with respect to vertical deflection which is above said flange.

6. The method of claim 5 wherein said moldable material comprises concrete.

7. The method of claim 6 wherein said lower support member comprises a steel beam.

8. The method of claim 5 wherein said lower support member comprises first and second steel beams joined at said flange.

9. The method of claim 8 wherein said first and second steel beams have first and second flanges, respectively, which are joined to form said flange.

* * * * *